US006175988B1

(12) United States Patent
White et al.

(10) Patent No.: US 6,175,988 B1
(45) Date of Patent: Jan. 23, 2001

(54) BYPASS VACUUM CLEANER WITH FLEXIBLE VACUUM HOSE STORED OVER MOTOR COOLING AIR SHROUD AND CARRYING HANDLE

(75) Inventors: James A. White, Louisville; Aaron J. Potts, Carrollton, both of OH (US); Thomas J. DeBlasis; Dino A. Mariano, both of Pittsburgh, PA (US)

(73) Assignee: Overhead Door Corporation, Dallas, TX (US)

( * ) Notice: Under 35 U.S.C. 154(b), the term of this patent shall be extended for 0 days.

(21) Appl. No.: 09/352,083

(22) Filed: Jul. 14, 1999

(51) Int. Cl.[7] ..... A47L 9/32

(52) U.S. Cl. ..... 15/327.1; 15/413; 15/327.6; 15/323

(58) Field of Search ..... 15/413, 327.1, 15/327.6, 323, 353; 417/423.2

(56) References Cited

U.S. PATENT DOCUMENTS

| | | | | |
|---|---|---|---|---|
| D. 346,053 | | 4/1994 | Hoshino | D32/31 |
| 2,233,167 | * | 2/1941 | Holm-Hansen | 15/327.6 |
| 2,332,208 | * | 10/1943 | Dow | 15/323 |
| 2,531,920 | * | 11/1950 | Raminger | 15/327.1 |
| 2,731,103 | * | 1/1956 | Ortega | 15/327.1 |
| 2,935,760 | * | 5/1960 | Martinec | 15/323 |
| 3,413,779 | * | 12/1968 | Takahashi et al. | 15/327.1 |
| 3,815,172 | * | 6/1974 | Fromknect et al. | 15/413 |
| 4,120,616 | | 10/1978 | Dwyer et al. | 417/373 |
| 4,330,899 | | 5/1982 | Miller et al. | 15/326 |
| 4,538,971 | | 9/1985 | Miller et al. | 417/423.2 |
| 4,621,991 | * | 11/1986 | Smith et al. | 417/423.2 |
| 4,628,566 | * | 12/1986 | Klapperich | 15/327.1 |
| 4,880,364 | | 11/1989 | Berfield et al. | 1471/423.1 |
| 4,939,809 | * | 7/1990 | Park | 15/353 |
| 5,247,719 | * | 9/1993 | Wareham et al. | 15/323 |
| 5,303,447 | * | 4/1994 | McKnight | 15/323 |
| 5,386,613 | * | 2/1995 | Woo | 15/353 |
| 5,742,976 | * | 4/1998 | Bensussen et al. | 15/323 |
| 5,787,546 | * | 8/1998 | Bass et al. | 15/344 |
| 5,836,046 | | 11/1998 | Huffman et al. | 15/321 |
| 5,943,731 | * | 8/1999 | Wood | 15/323 |
| 6,003,200 | * | 12/1999 | Potts et al. | 15/413 |

* cited by examiner

*Primary Examiner*—Robert J. Warden, Sr.
*Assistant Examiner*—Theresa T. Snider
(74) *Attorney, Agent, or Firm*—Akin, Gump, Strauss, Hauer & Feld, L.L.P.

(57) ABSTRACT

An electric motor driven bypass type vacuum cleaner apparatus, particularly adapted for wet/dry debris collection includes an open top debris collection tank having opposed integrally formed cup-shaped feet for supporting said apparatus in a stable position on a support surface. The tank includes a recess in a sidewall and a bottom wall for receiving a conduit member which may be interchangeably used as a connector for connecting a flexible vacuum hose to the tank and as a blower discharge nozzle. A flexible vacuum pickup hose is connected to the conduit member generally at the bottom side of the debris collection tank and, in a stored position on the apparatus, is trained through a recess in the bottom wall of the tank and over the top of a motor housing and shroud assembly to a connection point in one of the support feet adjacent the conduit member. The vacuum hose, when stored, is retained in a recess in the shroud which also serves as a carrying handle for the apparatus. The vacuum impeller drive motor is mounted in a housing assembly including separable tank cover, motor base and motor housing members. The motor base and tank cover form a discharge volute chamber for the vacuum impeller. Motor cooling air inlet and discharge passages are formed by and between the motor housing member and the shroud.

23 Claims, 5 Drawing Sheets

BYPASS VACUUM CLEANER WITH FLEXIBLE VACUUM HOSE STORED OVER MOTOR COOLING AIR SHROUD AND CARRYING HANDLE

FIELD OF THE INVENTION

The present invention pertains to a tank mounted electric motor driven bypass type vacuum cleaner apparatus adapted for wet/dry cleaning operations.

BACKGROUND

In the art of motor driven vacuum cleaners there have been substantial development efforts directed to providing apparatus driven by electric motors, in general, which are tank mounted, are basically of the bypass type and are adapted for wet/dry cleaning operations. In the further development of this general type of vacuum cleaner there has been a continuing need to provide a compact, easily used apparatus which is economical to manufacture but which is also provided with features which are necessary and desirable. Such features include construction of the apparatus to provide a minimum number of parts which may be easily fabricated, assembled and disassembled. Operational features which are desirable include reduced noise emission and circulation of motor cooling air to and from the apparatus, also at reduced noise emission, and without mixing heated cooling air flowing away from the motor, as well as bypass vacuum exhaust airflow with motor inlet cooling air. Further operational features which have been sought include stability of the apparatus when in use to minimize the chance of debris collection tank upset, portability, and storage for the vacuum cleaner pickup hose and associated tools or nozzles, and the power cord. It is to the above-mentioned ends as well as providing other desiderata in portable tank type vacuum cleaner apparatus that the present invention has been directed.

SUMMARY OF THE INVENTION

The present invention provides an improved vacuum cleaner apparatus which is adapted for both wet and dry cleaning operations.

In accordance with one important aspect of the invention, a motor driven vacuum cleaner apparatus is provided which includes an improved arrangement and combination of a debris collection tank, a tank cover, a motor support base member, a motor cover or housing and a cooling airflow shroud and carrying handle. The aforementioned parts are configured to be easily fabricated and assembled to each other and disassembled from each other. In particular, the cooling airflow shroud is provided with a carrying handle which is also provided with a recess for receiving a portion of a flexible vacuum or debris pickup hose.

In accordance with another aspect of the invention a lightweight, portable, tank-type bypass vacuum cleaner is provided which includes a debris collection tank and motor housing assembly configured to provide for convenient storage of an elongated flexible debris pickup hose. Still further, the debris collection tank is configured to releasably support a conduit member which is connectable to the flexible debris pickup hose, which conduit member may be removed from the debris collection tank and used as an air blower nozzle by connecting the conduit and the flexible hose to the apparatus vacuum air exhaust port. Still further, the debris collection tank is adapted to provide a recess for supporting a vacuum cleaning nozzle or the like.

The vacuum cleaner apparatus of the present invention further provides an improved arrangement of parts for conducting motor cooling airflow to and from an electric motor for driving a vacuum air impeller of the apparatus. An arrangement of a motor housing and cooling air shroud or cover provides for unobstructed cooling airflow while reducing noise emissions and while directing the cooling airflow in such a way as to substantially prevent commingling of heated motor cooling air being discharged from the apparatus with ambient cooling air being drawn into the motor cooling air inlet flowpath.

The present invention still further provides a portable lightweight motor driven vacuum cleaning apparatus which includes a debris collection tank having a configuration which provides improved stability of the apparatus in use to reduce the chance of upset, a convenient carrying handle and hose storage arrangement and an improved power cord storage arrangement.

Those skilled in the art will further appreciate the above-mentioned advantages and superior features of the vacuum cleaner apparatus of the invention together with other important aspects thereof upon reading the detailed description which follows in conjunction with the drawing.

DETAILED DESCRIPTION OF A PREFERRED EMBODIMENT

Figure 1:
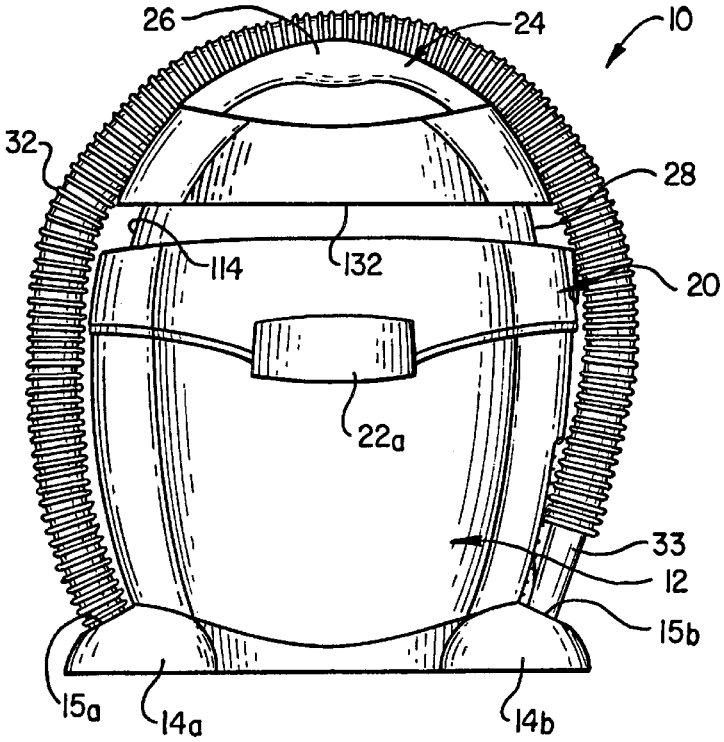
FIG. 1 is a front elevation of the vacuum cleaner apparatus of the present invention.

In the description which follows, like parts are marked throughout the specification and drawing with the same reference numerals, respectively. The drawing figures may not necessarily be to scale and certain features of the invention may be shown in somewhat schematic form in the interest of clarity and conciseness.

Figure 2:
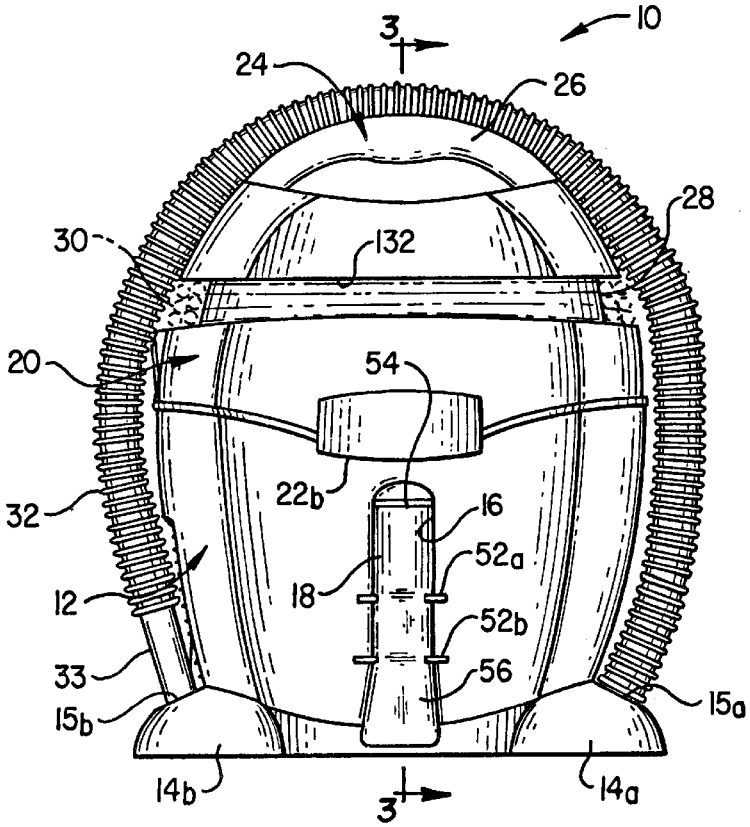
FIG. 2 is a rear elevation of the vacuum cleaner apparatus.

Referring to FIGS. 1 and 2, an improved tank-type bypass vacuum cleaner apparatus in accordance with the invention is illustrated and generally designated by the numeral 10. The apparatus 10 is characterized by a somewhat oval cross section shaped debris collection tank 12 having opposed integrally formed inverted cup shaped feet 14*a* and 14*b* and a recess 16, FIG. 2, in one sidewall of the tank for receiving a debris pickup nozzle or tool 18 releasably secured therein in a manner to be described in further detail herein.

Referring further to FIGS. 1 and 2, the vacuum cleaner apparatus 10 also includes a motor housing and tank cover assembly 20 releasably securable to the tank 12 by opposed integral latch members 22*a*, FIG. 1, and 22*b*, FIG. 2, which are cooperable with integral latch bosses, not shown in FIGS. 1 and 2, on the tank 12 to releasably secure the motor housing and tank cover assembly in a working position on the tank 12. As further shown in FIGS. 1 and 2, the apparatus 10 includes a combination cooling air shroud and handle member 24 which is adapted to be removably secured to the assembly 20 and is provided with a handle portion 26 which functions as a carrying handle for the apparatus 10. As shown in FIGS. 1 and 2, the motor housing and tank cover assembly 20 and the shroud 24 cooperate to provide a circumferential recess 28 to provide for storage of an electrical power cord 30, FIG. 2, for the apparatus 10, which power cord is suitably connected to an electric motor and associated controls, not shown, for the apparatus 10. Power cord 30 may be wrapped around the housing and tank cover assembly 20 within the recess 28 for convenient storage of such cord.

Still further, referring to FIGS. 1 and 2, the vacuum cleaner apparatus 10 advantageously includes an elongated flexible debris pickup hose member 32 which is suitably connected to an inlet port, not shown, for the tank 12, extends through an opening 15*a* in the foot 14*a* and, in a stored position, extends over the shroud and handle member 24 and down the opposite side of the tank 12 to a distal end part 33 which is storable in a recess 15*b* formed in the tank support foot 14*b*. As illustrated more particularly in FIGS. 3 and 4, the shroud 24 is provided with an arcuate groove or recess 26*a* for receiving a portion of the hose 32 extending over the top of the handle portion or part 26, as illustrated in FIGS. 1 and 2.

Figure 3:
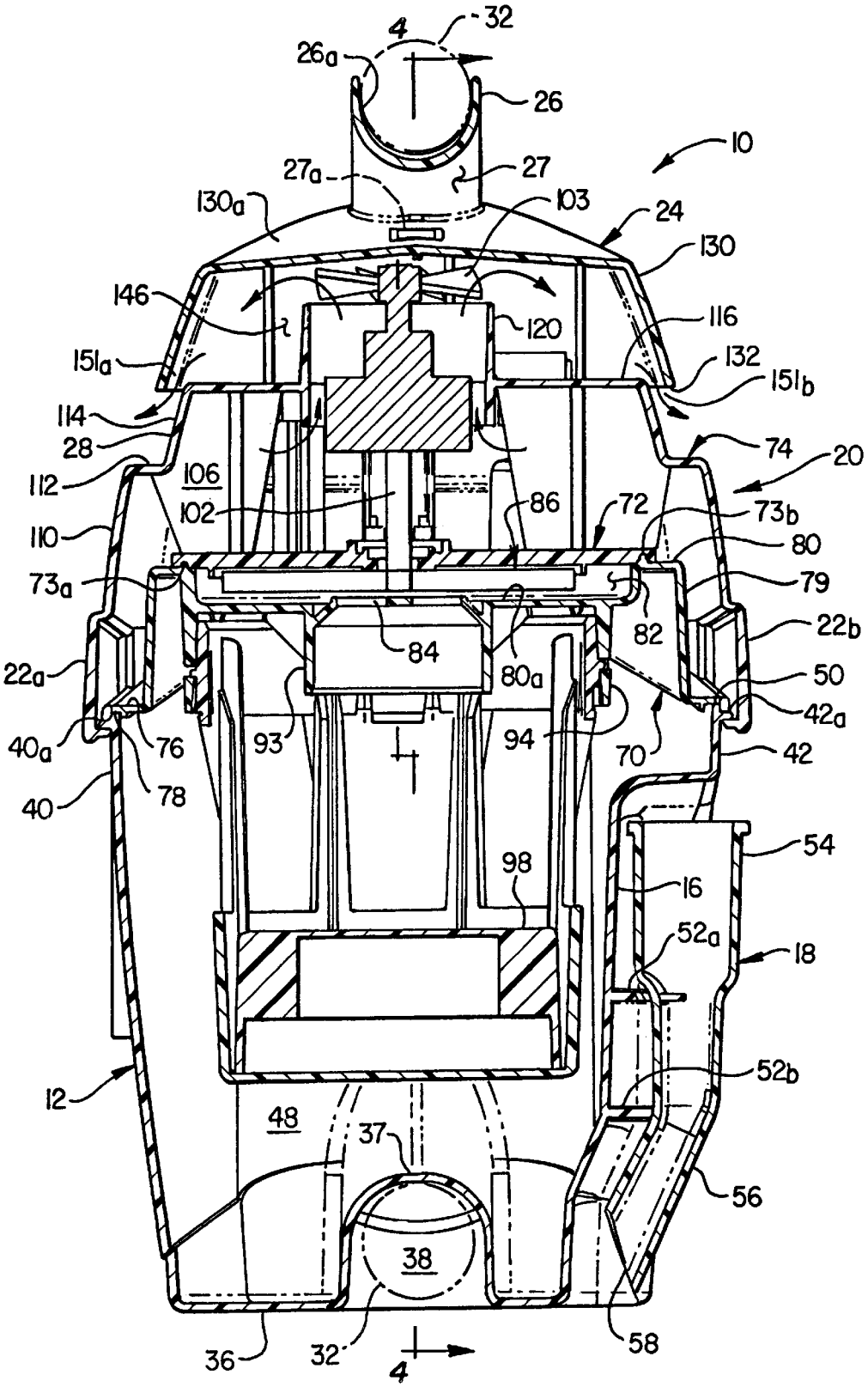
FIG. 3 is a section view taken generally along the line 3—3 of FIG. 2.
Figure 4:
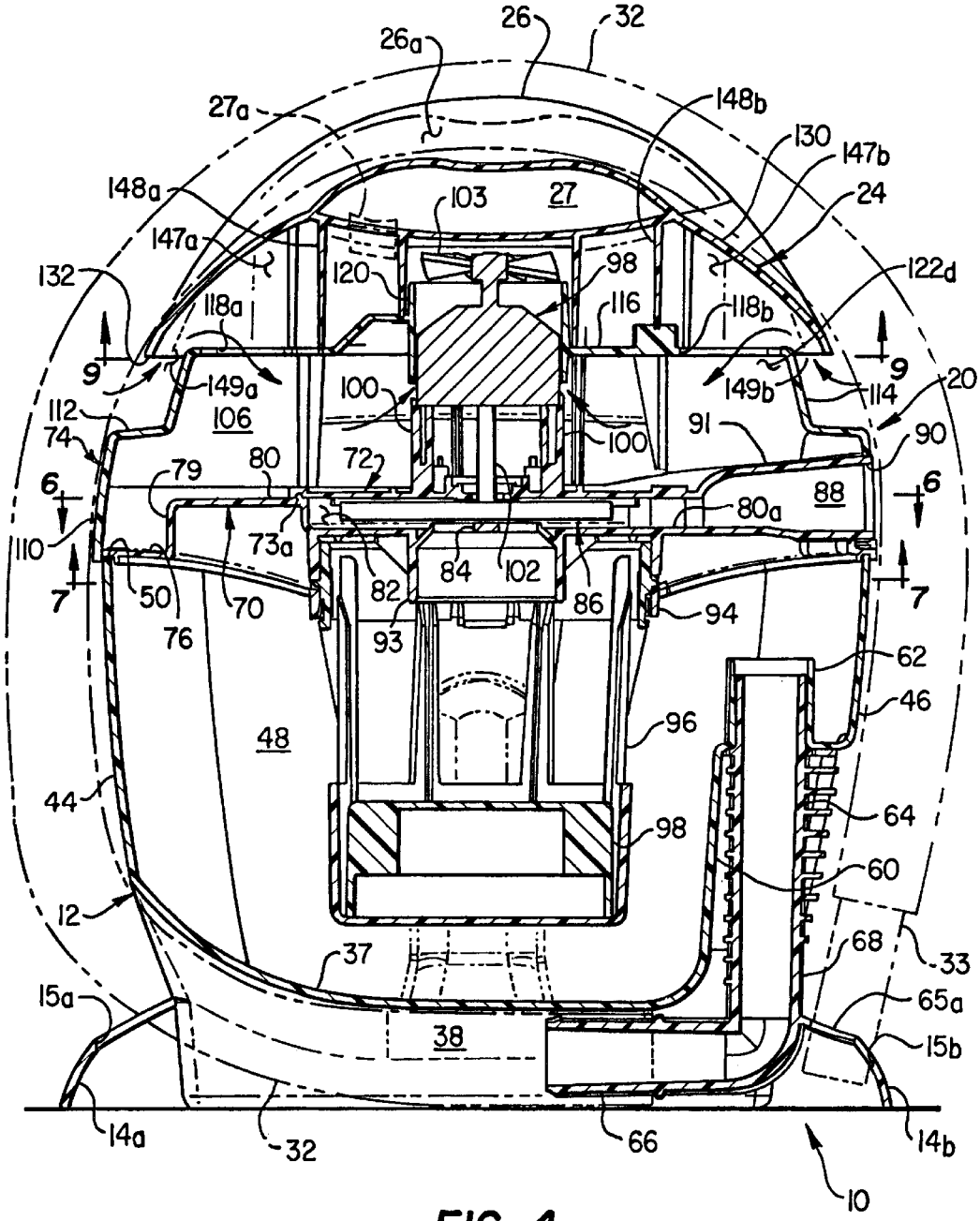
FIG. 4 is a section view taken generally along the line 4—4 of FIG. 3.
Figure 5:
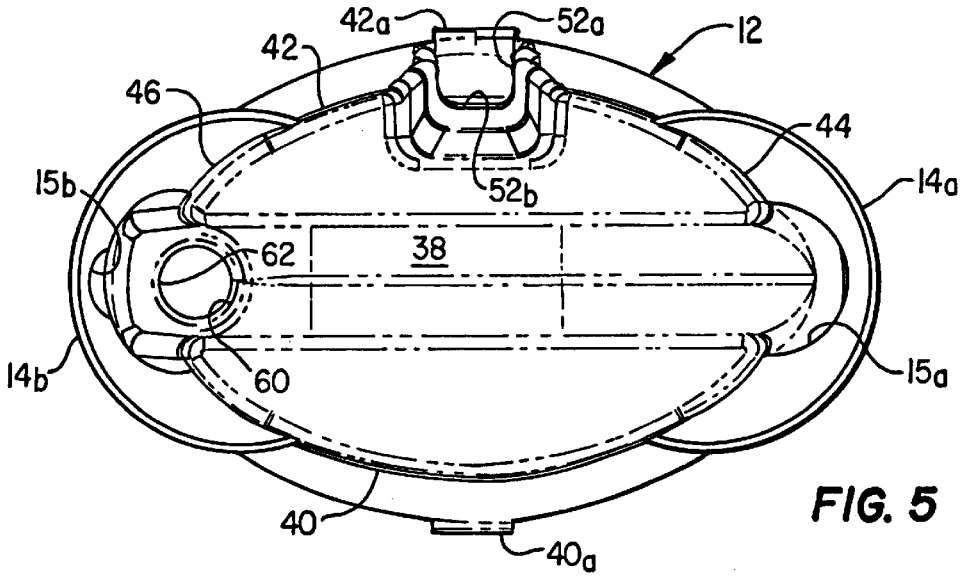
FIG. 5 is a bottom plan view of the debris collection tank for the vacuum cleaner apparatus.

Referring now to FIGS. 3, 4 and 5, the debris collection tank 12 is preferably formed as a molded plastic member having a bottom wall 36 delimited partially by an arcuate upstanding part 37 defining a hose receiving recess 38 which is in communication with the recess 15*a*, FIG. 4. The bottom wall 36 is integrally joined to opposed sidewall portions 40 and 42 which are integral with somewhat oval opposed endwalls 44 and 46, FIGS. 4 and 5, essentially forming a continuous sidewall. The walls 40, 42, 44 and 46 blend into each other to form the somewhat oval or elliptical shape of the tank 12 and defining a debris receiving chamber 48 formed therewithin. A peripheral rim 50, FIGS. 3 and 4, defines the upper open end of the tank 12. As also shown in FIG. 3, the opposed sidewalls 40 and 42 are provided with integral latch bosses 40*a* and 42*a*, respectively, for engagement with the resiliently deflectable latch members 22*a* and 22*b* of the housing assembly 20.

As shown in FIG. 5, the relatively large, hollow arcuate feet 14*a* and 14*b*, which are integrally formed with the tank 12 advantageously provide improved stability of the apparatus 10 when supported on a suitable support surface. The tank sidewall 42 is delimited by the vertically extending channel-shaped recess 16 in which spaced apart, somewhat u-shaped retainer flanges 52*a* and 52*b* are formed, see FIGS. 3 and 5, for releasably retaining the nozzle or tool 18 secured to the tank 12 for storage and transport purposes. The nozzle 18 is advantageously provided with a generally cylindrical tubular connector part 54, FIG. 3, which blends into a substantially rectangular cross section nozzle part 56 having a scarfed and flared debris pickup end or nose 58, FIG. 3.

As shown in FIGS. 4 and 5, the tank endwall portion 46 includes an elongated, vertically extending recess 60 which opens to the recesses 38 and 15*b*. A cylindrical tank inlet port 62 is formed at an upper end of the recess 60 for receiving an elongated, substantially rigid and somewhat L-shaped conduit member 64 suitably secured therein by a mild, releasable force fit. The conduit member 64 includes a leg portion 66 extending normal to a leg portion 68, the leg portion 66 extending within the recess 38 and adapted to be connected to one end of the hose 32, as shown in FIG. 4. The hose 32 is, in a stored position thereof, trained through the recess 38, the recess 15*a* and upwardly over the shroud 24 and handle portion 26 nested in recess 26*a*, and then for securement of the distal end 33 within the recess 15*b*, as illustrated. In this regard also conduit member 64 includes a laterally projecting retainer flange 65*a* formed thereon, as shown in FIG. 4, which cooperates with foot 14*b* and recess 15*b* formed therein for retaining hose end 33.

An important advantage of the vacuum cleaner apparatus 10 resides in the provision of the connection point of the flexible vacuum hose 32 to the apparatus at a location which is essentially at the bottom of the debris collection tank 12. In fact, by providing for connection of the hose 32 to the leg portion 66 of the conduit member 64 within the recess 38, when the vacuum cleaner apparatus is in use and the user pulls on the hose 32 during operation, there is virtually no tendency to upset the apparatus since the point at which the pulling force is applied is below the center of gravity of the apparatus. The overall combination of features of the point of attachment of the flexible hose 32 to the conduit member 64 and the wide footprint of the apparatus provided by the inverted cup-shaped feet 14*a* and 14*b* provides enhanced stability for the apparatus which is particularly important for operating conditions wherein liquid is being collected in the debris collection tank. Moreover, any debris remaining in the flexible hose 32 and the conduit member 64 when power is turned off and the apparatus is shut down, is substantially prevented from spilling out of the hose 32, as is experienced with prior art vacuum cleaners which have a point of attachment of the vacuum hose near the top end of the debris collection tank. Still further, as mentioned previously, by attaching the vacuum hose 32 to the debris collection tank 12 essentially at the bottom of the tank, the vacuum hose is also more conveniently stored on the apparatus by training the hose upward along one side of the tank, over the top of the apparatus and down the opposite side of the tank, as illustrated and described.

Figure 6:
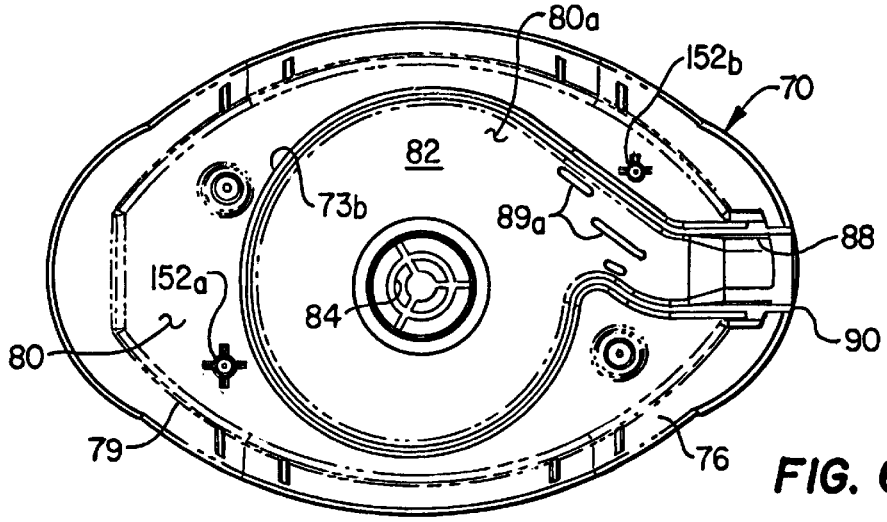
FIG. 6 is a top plan view of the tank cover member, taken generally from the line 6—6 of FIG. 4.
Figure 7:
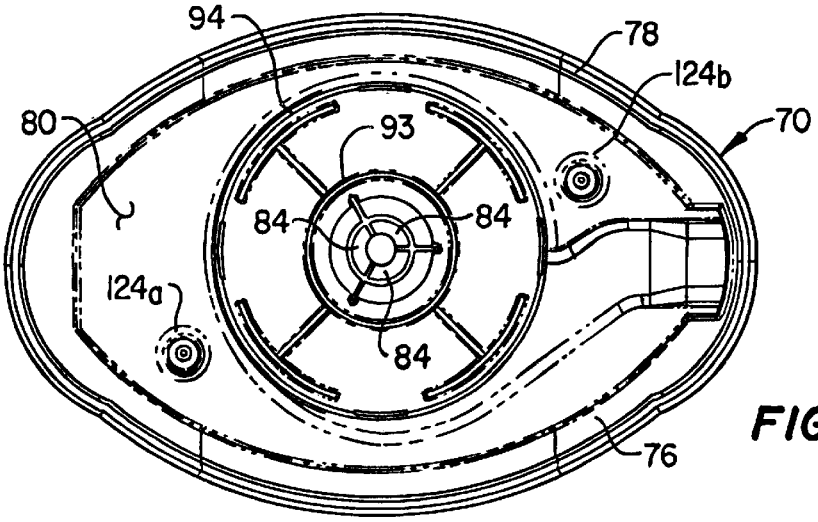
FIG. 7 is a bottom plan view of the tank cover member, taken generally from the line 7—7 of FIG. 4.

Referring further to FIGS. 3 and 4, the housing assembly 20 preferably comprises a multipart structure including a tank cover member 70, a motor base member 72 and a motor housing 74 held in assembly by conventional threaded fasteners in a manner to be described in further detail herein. As shown in FIGS. 6 and 7, the tank cover member 70 has a peripheral flange wall 76 delimited by the contour of the tank 12 and defining a continuous peripheral groove 78, FIG. 7, which is adapted to receive the upper rim or edge 50 of the tank 12 in substantially sealing engagement therewith when the latch members 22*a* and 22*b* are secured in the positions shown in FIG. 3. The tank cover 70 is also provided with an integral, peripheral wall 79, FIGS. 3 and 4, depending from a generally horizontally extending deck part 80 formed integral with the wall 79. The deck part 80 is provided with a scroll-like recess or volute chamber 82 delimited by a horizontal deck portion 80*a* in which is disposed a central port 84 for inflow of vacuum air to a centrifugal impeller 86, FIGS. 3 and 4, disposed in the volute chamber 82. An impeller discharge passage 88 extends generally radially from the volute chamber 82 through a cylindrical discharge port 90 formed by the tank cover 70 and a radially extending wall part 91 of the motor base member 72.

As shown in FIGS. 3 and 4, the tank cover 70 is also provided with an integral depending tubular boss 93 and a substantially concentric depending tubular skirt portion 94 for releasably supporting a generally cylindrical cage 96. The cage 96 is adapted to retain a float valve closure member 98 for movement within the cage into engagement with the boss 93 to cut off fluid flow through the port 84 and into the impeller 86 in the event that liquid accumulates in the tank 12 to a certain depth. Accordingly, air may flow into the tank chamber 48 through the port 62 and liquid entrained in the air may accumulate to a depth which will cause the float closure member 98 to move upward in the cage 96 and engage the boss 93 to close off fluid flow through the ports 84 and into the impeller 86.

Volute chamber 82 and discharge passage 88 are further defined by the motor base member 72 which fits over the chamber in engagement with the deck 80, as indicated in FIGS. 3 and 4. A suitable locating groove 73*a* may be formed in the motor base member 72 for registration with a locating flange 73*b* formed in the deck 80 of the tank cover member 70. As further shown in FIGS. 3 and 4, the motor base member 72 is adapted to support a generally cylindrical low horsepower AC electric motor 98 suitably mounted on opposed upstanding bosses 100 formed on the motor base member 72, FIG. 4. A rotatable motor output shaft 102 is suitably secured to the centrifugal impeller 86 for rotating same to discharge pressure air into the chamber 82 and the discharge passage 88. Suitable fixed airflow and sound deflecting guide vanes 89*a*, FIG. 6, may be molded in place extending from the deck portion 80*a* to guide discharge airflow from the impeller 86 through the passage 88 and the discharge port 90.

Figure 8:
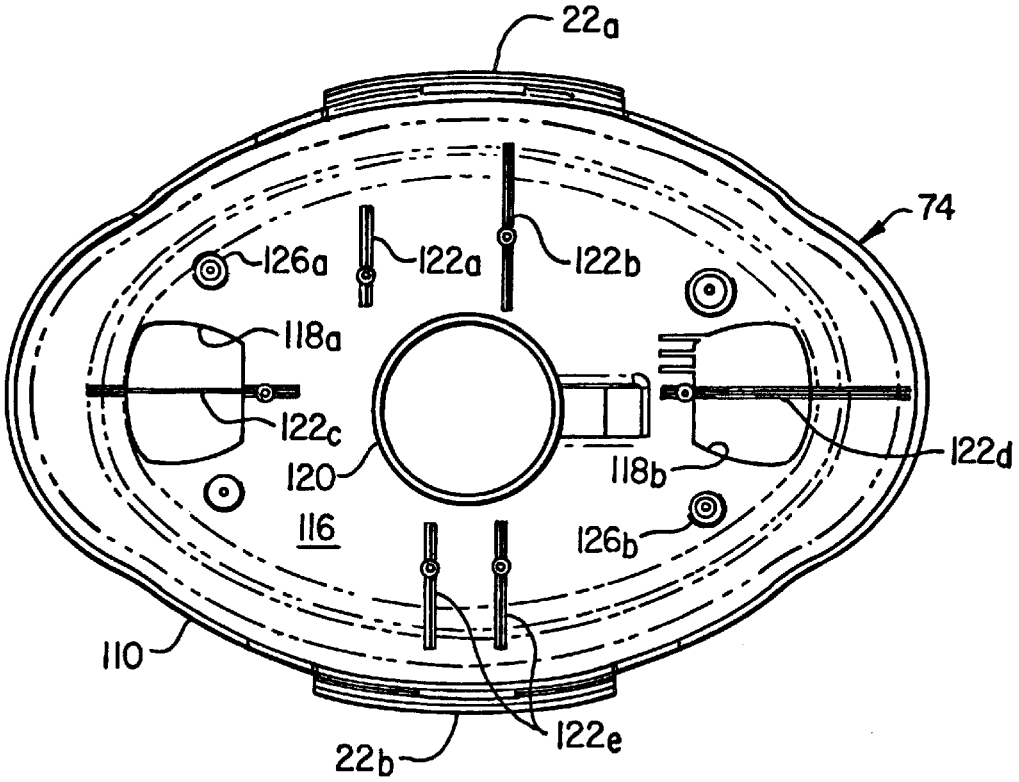
FIG. 8 is a bottom plan view of the motor housing also taken generally from line 7—7 with the tank cover omitted.

As further shown in FIGS. 3 and 4, the motor output shaft 102 is also affixed, at an end opposite the end which is connected to the impeller 86, to an axial flow motor cooling air fan 103. Cooling air fan 103, when operated in a preferred direction of airflow, draws motor cooling air axially through the motor 98 from a plenum 106, FIGS. 3 and 4, formed between the motor housing 74 and the tank cover 70 and also between the motor housing 74 and the motor base 72. Referring further to FIGS. 3 and 4, and also FIG. 8, the motor housing 74 is defined by a peripheral depending skirt 110 which is dimensioned to fit over the outer peripheral edge of the wall 76 of tank cover 70. Skirt or wall 110 is delimited by a generally horizontal peripheral deck part 112 which, with a generally vertically extending peripheral wall 114, at least partially defines the annular groove or recess 28 for storage of the power cord, not shown in FIGS. 3 and 4. Peripheral wall 114 is formed integral with a generally horizontal deck 116. As shown in FIGS. 3 and 8, the integral latch members 22*a* and 22*b* are formed integral with the skirt wall 110. Spaced apart motor cooling air ports 118*a* and 118*b* are formed in the deck 116 and a cylindrical tubular motor cooling air shroud 120, FIGS. 3, 4 and 8, is formed integral with and projecting from the deck 116 and is adapted to be in surrounding relationship to the motor 98 to control the flow of cooling air through fan 103 and over the motor. Plural, spaced apart, generally planar webs 122*a*, 122*b*, 122*c*, 122*d* and 122*e* project from deck 116, generally downwardly, see FIGS. 3, 4 and 8, and engage the motor base member 72 to retain the base in engagement with the tank cover 70 and sandwiched between the tank cover 70 and the motor housing 74.

As shown in FIGS. 7 and 8, fastener receiving bosses 124*a* and 124*b*, FIG. 7, formed in the tank cover 70 are cooperable with corresponding bosses 126*a* and 126*b*, FIG. 8, and are adapted to receive threaded fasteners, not shown, for securing the members 70 and 74 together with the motor base 72 securely disposed therebetween. The aforementioned fasteners are preferably inserted through the bosses from the bottom side of the deck 80 of the tank cover 70. Accordingly, the housing assembly 20 is made up of the members 70, 72 and 74 as an assembly which can be easily mounted on or demounted from the tank 12.

Figure 9:
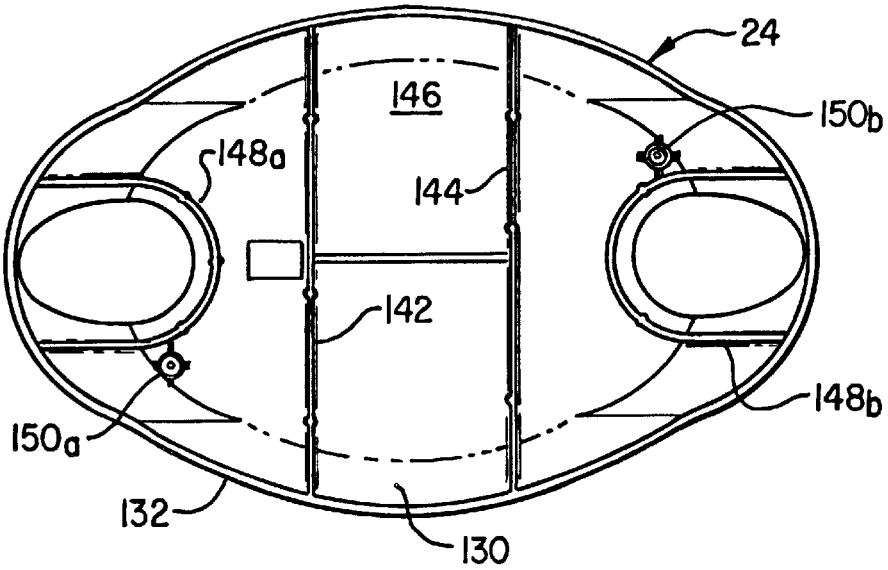
FIG. 9 is a bottom plan view of the cooling air shroud and handle member taken generally from the line 9—9 of FIG. 4.

Referring further to FIGS. 3, 4 and 9, the shroud 24 is characterized by a somewhat semi-oblate spheroid shaped wall 130 having a lower peripheral edge 132. The handle portion 26 may be formed as a separate part and suitably adhesively bonded to the wall 130 to form the opening 27 for grasping the handle portion 26. A motor operating switch 27*a* may be disposed in a roof portion 130*a* of the wall 130 and projecting into the opening 27 for ease of control of the motor 98. As shown in FIG. 9, spaced apart depending transverse partitions 142 and 144 extend laterally across the shroud 24 and provide a motor cooling air discharge channel 146 for conducting cooling air from the motor cooling air fan 103 to passages comprising opposed gaps 151*a* and 151*b* formed between the edge 132 of wall 130 and the upstanding peripheral wall 114 of the housing 74, see FIG. 3. Accordingly, motor cooling air may flow into opposed cooling air inlet chambers 147*a* and 147*b*, FIG. 4, then through ports 118*a* and 118*b* and be propelled by the fan 103 through the tubular shroud 120 and over motor 98 and into the plenum 146, FIG. 3. Chambers 147*a* and 147*b* are also defined by arcuate depending partitions or walls 148*a* and 148*b*, see FIG. 9 also. Heated cooling air is discharged from the plenum 146 through the respective cooling air discharge passages or gaps 151*a* and 151*b*, FIG. 3.

As shown in FIG. 4, in a preferred arrangement of motor cooling airflow, cooling air enters the chambers 147*a* and 147*b* through gaps 149*a* and 149*b* between the peripheral edge 132 and the upstanding wall 114 at opposite ends of the motor housing member 74 and substantially away from the area of cooling air discharge from the plenum 146. In this way, heated motor cooling air is not re-ingested into the motor during operation. Still further, bypass vacuum airflow is discharged laterally through the port 90 at one "end" of the tank 12, again at a location generally remote from the location of motor cooling air intake.

The shroud 24 is suitably secured to the motor housing 74 by suitable threaded fasteners which are inserted from the upper external surface of the wall 130 through bosses 150*a* and 150*b*, FIG. 9, which cooperate with bosses 152*a* and 152*b* formed on the tank cover 70, see FIG. 6. Accordingly, the shroud 24, the tank cover 70, the motor base member 72 and the motor housing 74 are all secured in assembly by only four threaded fasteners, two of which secure the shroud to the housing assembly 20 and two of which secure the three members 70, 72 and 74 of the housing assembly 20 together.

Those skilled in the art will recognize from the foregoing description that a particularly advantageous vacuum cleaner is provided by the present invention. The configuration of the nozzle or conduit 64 and the arrangement of the vacuum pickup hose 32 and its storage position is particularly advantageous as is the storage location of the tool or nozzle 18. Still further, the storage position of the power cord 30 is convenient and does not result in unraveling of the cord. The flowpaths of bypass vacuum exhaust air and motor cooling air are advantageous in that heated cooling air is not mixed with or ingested into the ambient cooling air flowpath.

The construction of the tank 12 is advantageous with regard to its stability provided in part by the arcuate cup-shaped feet 14*a* and 14*b*. The vacuum cleaner 10 may be easily fabricated and assembled and disassembled if required. Removal of the tank 12 from the remainder of the vacuum cleaner is easily accomplished. The major parts, such as the tank 12, the tank cover 70, the motor base member 72, the motor housing 74, the shroud 24, the nozzle or tool 18 and the nozzle 64 are advantageously fabricated of molded plastic, such as polypropylene. Components not otherwise identified herein may be suitably manufactured of conventional engineering materials used for motor driven vacuum cleaners.

Although a preferred embodiment of the invention has been described in detail herein, those skilled in the art will recognize that various substitutions and modifications may be made without departing from the scope and spirit of the appended claims.

What is claimed is:

1. A vacuum cleaner apparatus comprising:

a debris collection tank having a bottom wall, an upstanding sidewall and an open top;

a housing assembly adapted to be releasably connected to said tank for covering said open top, said housing assembly comprising a tank cover member and a motor support base member forming a discharge volute chamber therebetween;

a flexible vacuum hose adapted to be connected to said tank;

a centrifugal impeller disposed in said volute chamber for discharging bypass vacuum air through said volute chamber to the exterior of said vacuum cleaner;

an electric motor supported by said housing assembly and drivingly connected to said impeller;

a motor cooling air shroud mounted on said housing assembly and forming, at least in part, a motor cooling air inlet passage and a motor cooling air discharge passage for conducting motor cooling air to and from said motor, said shroud including a handle part for carrying said vacuum cleaner apparatus said handle part including a recess therein for receiving part of said vacuum hose in a stored position of said vacuum hose on said apparatus; and a motor cooling air fan drivenly connected to said motor.

2. The vacuum cleaner apparatus set forth in claim 1 wherein:

said tank cover member is releasably secured to a motor housing member with said motor base member disposed therebetween.

3. The vacuum cleaner apparatus set forth in claim 2 wherein:

said shroud is releasably secured to said housing assembly.

4. The vacuum cleaner apparatus set forth in claim 1 including:

a vacuum air inlet port in said tank cover member and opening into said volute chamber, support means for a float valve closure member mounted on said tank cover member and a float valve closure member supported by said support means and operable to close over said inlet port in said tank cover member to shutoff vacuum airflow to said impeller.

5. The vacuum cleaner apparatus set forth in claim 1 wherein:

said tank includes a pair of opposed integral feet extending from said bottom wall for supporting said apparatus on a support surface.

6. The vacuum cleaner apparatus set forth in claim 5 wherein:

said feet comprise opposed, generally arcuate inverted cup-shaped members integrally formed with said tank.

7. A vacuum cleaner apparatus comprising:

a debris collection tank having a bottom wall, an upstanding sidewall and a n open top;

a housing assembly adapted to be releasably connected to said tank for covering said open top, said housing assembly comprising a tank cover member and a motor support base member forming a discharge volute chamber therebetween;

a centrifugal impeller disposed in said volute chamber for discharging bypass vacuum air through said volute chamber to the exterior of said vacuum cleaner;

an electric motor supported by said housing assembly and drivingly connected to said impeller;

a motor cooling air fan drivenly connected to said motor; and a motor cooling air shroud mounted on said housing assembly and forming, at least in part, a motor cooling air inlet passage and a motor cooling air discharge passage for conducting motor cooling air to and from said motor, said shroud including spaced apart partitions defining opposed motor cooling air inlet passages for conducting motor cooling air from the exterior of said apparatus to said fan.

8. The vacuum cleaner apparatus set forth in claim 7 wherein:

said housing assembly includes a plenum defined between said tank cover member and a motor support housing member secured to said tank cover member, motor cooling air inlet ports formed in said motor housing member and in communication with spaced apart opposed motor cooling air inlet chambers formed in said shroud and disposed adjacent said inlet ports, respectively.

9. A vacuum cleaner apparatus comprising:

a debris collection tank having a bottom wall, an upstanding sidewall, an open top and a vacuum air inlet port formed therein;

a housing assembly adapted to be releasably connected to said tank for covering said open top, said housing assembly comprising a tank cover member and a motor support base member forming a discharge volute chamber therebetween;

a centrifugal impeller disposed in said volute chamber for discharging bypass vacuum air through said volute chamber to the exterior of said vacuum cleaner;

an electric motor supported by said housing assembly and drivingly connected to said impeller;

a motor cooling air shroud mounted on said housing assembly and forming, at least in part, a motor cooling air inlet passage and a motor cooling air discharge passage for conducting motor cooling air to and from said motor;

a motor cooling air fan drivenly connected to said motor;

a flexible vacuum hose; and a conduit member for connecting said vacuum hose to said inlet port in said tank, said conduit member is disposed in a recess in said sidewall of said tank and connectable to one end of said vacuum hose, said vacuum hose being storable on said apparatus trained over and engaged with said shroud.

10. The vacuum cleaner apparatus set forth in claim 9 including:

a recess formed in said bottom wall of said tank and adapted to receive at least a part of said vacuum hose.

11. A vacuum cleaner apparatus comprising:

a debris collection tank having a bottom wall, an upstanding sidewall, an open top and a vacuum air inlet port formed therein;

a housing assembly adapted to be releasably connected to said tank for covering said open top, said housing assembly comprising a tank cover member and a motor support base member forming a discharge volute chamber therebetween;

a centrifugal impeller disposed in said volute chamber for discharging bypass vacuum air through said volute chamber to the exterior of said vacuum cleaner;

an electric motor supported by said housing assembly and drivingly connected to said impeller;

a flexible vacuum hose storable on said apparatus;

a motor cooling air shroud mounted on said housing assembly and forming, at least in part, a motor cooling air inlet passage and a motor cooling air discharge passage for conducting motor cooling air to and from said electric motor and a recess formed in said shroud for receiving at least part of said vacuum hose between opposite ends thereof when said vacuum hose is in a stored position on said apparatus; and a motor cooling air fan drivenly connected to said motor.

12. The vacuum cleaner apparatus set forth in claim 11 including:

means on said tank for retaining a distal end of said vacuum hose connected thereto when said vacuum hose is stored on said apparatus.

13. A vacuum cleaner apparatus comprising:

a debris collection tank having a bottom wall, an upstanding sidewall, an open top and a vacuum air inlet port formed therein;

a housing assembly adapted to be releasably connected to said tank for covering said open top, said housing assembly comprising a tank cover member and a motor support base member forming a discharge volute chamber therebetween;

a centrifugal impeller disposed in said volute chamber for discharging bypass vacuum air through said volute chamber to the exterior of said vacuum cleaner;

an electric motor supported by said housing assembly and drivingly connected to said impeller;

a motor cooling air shroud mounted on said housing assembly and forming, at least in part, a motor cooling air inlet passage and a motor cooling air discharge passage for conducting motor cooling air to and from said motor;

a motor cooling air fan drivenly connected to said motor; and said housing assembly including a peripheral wall portion defining with said shroud a circumferential recess for receiving a power cord adapted to be wrapped around said peripheral wall portion and stored in said recess.

14. A vacuum cleaner apparatus comprising:

a debris collection tank having a bottom wall, an upstanding sidewall and a vacuum air inlet port;

a housing assembly adapted to be releasably connected to said tank, said housing assembly defining a vacuum air discharge chamber, a centrifugal impeller for discharging bypass vacuum air through said discharge chamber to a vacuum air discharge port, an electric motor supported on said housing assembly and drivingly connected to said impeller, and a motor cooling air fan drivenly connected to said motor;

a motor cooling air shroud disposed on said housing assembly;

a section of vacuum conduit extending downwardly from and connected to said inlet port; and a flexible vacuum hose connected to said vacuum conduit and extending under said tank and operable to extend upward from a bottom portion of said tank, and said vacuum hose being further operable to be trained over said housing assembly and said shroud and having a distal end disposed adjacent said vacuum conduit in a stored position of said vacuum hose on said apparatus.

15. The vacuum cleaner apparatus set forth in claim 14 wherein:

said housing assembly includes a tank cover member, a motor housing member secured to said tank cover member and a plenum disposed between said cover member and said motor housing member, motor cooling air inlet ports formed in said motor housing member and in communication with motor cooling air inlet chambers formed in said shroud and disposed adjacent said cooling air inlet ports, respectively.

16. The vacuum cleaner apparatus set forth in claim 14 including:

a recess formed in a sidewall of said tank and a retainer disposed in said recess for releasably retaining a vacuum air nozzle in said recess and supported on said tank.

17. The vacuum cleaner apparatus set forth in claim 14 wherein:

said tank includes a pair of opposed integral feet extending from said bottom wall for supporting said vacuum cleaner apparatus on a support surface.

18. The vacuum cleaner apparatus set forth in claim 17 wherein:

said feet comprise opposed, generally inverted cup-shaped members integrally formed with said tank.

19. The vacuum cleaner apparatus set forth in claim 14 wherein:

said shroud includes a handle part for carrying said vacuum cleaner apparatus.

20. A vacuum cleaner apparatus comprising:

a debris collection tank having a bottom wall, an upstanding sidewall and a vacuum air inlet port;

a housing assembly adapted to be releasably connected to said tank, said housing assembly defining a vacuum air discharge chamber, a centrifugal impeller for discharging bypass vacuum air through said discharge chamber to a vacuum air discharge port, an electric motor supported on said housing assembly and drivingly connected to said impeller, and a motor cooling air fan drivenly connected to said motor;

a motor cooling air shroud disposed on said housing assembly;

a flexible vacuum hose operably connected to said inlet port and extending upward from a bottom portion of said tank and trained over said housing assembly and said shroud in a stored position of said vacuum hose on said apparatus; and a recess formed in said bottom wall of said tank and adapted to receive at least a part of said vacuum hose.

21. A vacuum cleaner apparatus comprising:

a debris collection tank having a bottom wall, an upstanding sidewall and a vacuum air inlet port;

a housing assembly adapted to be releasably connected to said tank, said housing assembly defining a vacuum air discharge chamber, a centrifugal impeller for discharging bypass vacuum air through said discharge chamber to a vacuum air discharge port, an electric motor supported on said housing assembly and drivingly connected to said impeller, and a motor cooling air fan drivenly connected to said motor;

a motor cooling air shroud disposed on said housing assembly;

a flexible vacuum hose operably connected to said inlet port and extending upward from a bottom portion of said tank and trained over said housing assembly and said shroud in a stored position of said vacuum hose on said apparatus;

a conduit member disposed in a recess formed in said sidewall of said tank and connected to said vacuum hose; and said vacuum hose being operable to be connected to said vacuum air discharge port at one end of said vacuum hose and to said conduit member at another end of said vacuum hose for operating said conduit member as a blower nozzle for discharging pressure air through said vacuum hose from said discharge port.

22. A vacuum cleaner apparatus comprising:

a debris collection tank having a bottom wall, an upstanding sidewall and a vacuum air inlet port;

a housing assembly adapted to be releasably connected to said tank, said housing assembly defining a vacuum air discharge chamber, a centrifugal impeller for discharging bypass vacuum air through said discharge chamber to a vacuum air discharge port, an electric motor supported on said housing assembly and drivingly connected to said impeller, and a motor cooling air fan drivenly connected to said motor;

a motor cooling air shroud disposed on said housing assembly;

a flexible vacuum hose operably connected to said inlet port and extending upward from a bottom portion of said tank and trained over said housing assembly and said shroud in a stored position of said vacuum hose on said apparatus; and a recess formed in said shroud for receiving at least part of said vacuum hose between opposite ends thereof when said vacuum hose is in a stored position on said apparatus.

23. A vacuum cleaner apparatus comprising:

a debris collection tank having a bottom wall, an upstanding sidewall and a vacuum air inlet port;

a housing assembly adapted to be releasably connected to said tank, said housing assembly defining a vacuum air discharge chamber, a centrifugal impeller for discharging bypass vacuum air through said discharge chamber to a vacuum air discharge port, an electric motor supported on said housing assembly and drivingly connected to said impeller, and a motor cooling air fan drivenly connected to said motor;

a motor cooling air shroud disposed on said housing assembly;

said housing assembly includes a peripheral wall portion defining with said shroud a circumferential cord storage recess for receiving a power cord adapted to be wrapped around said peripheral wall portion and stored in said cord storage recess; and a flexible vacuum hose operably connected to said inlet port and extending upward from a bottom portion of said tank and trained over said housing assembly and said shroud in a stored position of said vacuum hose on said apparatus.

* * * * *